US009327514B2

(12) United States Patent
Nishiyama et al.

(10) Patent No.: US 9,327,514 B2
(45) Date of Patent: May 3, 2016

(54) INKJET PRINTING APPARATUS

(71) Applicant: RISO KAGAKU CORPORATION, Tokyo (JP)

(72) Inventors: Akira Nishiyama, Ibaraki (JP); Hiroshi Sugitani, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/801,069

(22) Filed: Jul. 16, 2015

(65) Prior Publication Data

US 2016/0031226 A1 Feb. 4, 2016

(30) Foreign Application Priority Data

Jul. 30, 2014 (JP) ..... 2014-155064

(51) Int. Cl.
*B41J 2/175* (2006.01)

(52) U.S. Cl.
CPC ..... *B41J 2/17596* (2013.01)

(58) Field of Classification Search
CPC ..... B41J 2/175; B41J 2/18; B41J 2/17596
See application file for complete search history.

(56) References Cited

U.S. PATENT DOCUMENTS 6,082,851 A * 7/2000 Shihoh ..... B41J 2/175 347/85
6,386,689 B1 * 5/2002 Sasada ..... 347/85
8,794,747 B2 * 8/2014 Enomoto et al. ..... 347/85
2008/0024553 A1 * 1/2008 Morgan ..... B41J 2/1707 347/42
2008/0151014 A1 * 6/2008 Matsuda ..... B41J 2/17596 347/85
2008/0158307 A1 7/2008 Nitta et al.
2010/0177148 A1 * 7/2010 Asami ..... B41J 2/175 347/85
2010/0247769 A1 * 9/2010 Ooishi ..... B41J 2/175 427/256
2012/0299989 A1 * 11/2012 Prothon et al. ..... 347/6
2014/0043381 A1 * 2/2014 Izawa ..... B41J 2/17596 347/6

FOREIGN PATENT DOCUMENTS

JP 2008-162262 7/2008

* cited by examiner

*Primary Examiner* — Stephen Meier
*Assistant Examiner* — John P Zimmermann
(74) *Attorney, Agent, or Firm* — Greenblum & Bernstein, P.L.C.

(57) ABSTRACT

A common air chamber is connected to an air layer of a pressurizing tank and to an air layer of a negative-pressure tank. A pressurizing-side communication valve opens/closes an air channel in an air conduit between the pressurizing tank and the common air chamber. A negative-pressure side communication valve opens/closes an air channel in an air conduit between the negative-pressure tank and the common air chamber. A negative-pressure tank atmospheric air opening valve switches the negative-pressure tank between a state shut off from the atmospheric air and a state open thereto. The pressurizing-side communication valve and the negative-pressure tank atmospheric air opening valve are of a normally-open type closed when electrified and open when not. The negative-pressure side communication valve is of a normally-closed type open when electrified and closed when not. While not electrified, a nozzle pressure of an inkjet head becomes a meniscus breakage pressure or less.

5 Claims, 4 Drawing Sheets

| | | NEGATIVE-PRESSURE TANK LEVEL SENSOR | |
|---|---|---|---|
| | | ON | OFF |
| PRESSURIZING TANK LEVEL SENSOR | ON | INK PUMP: OFF<br>INK SUPPLY VALVE: CLOSE | INK PUMP: OFF<br>INK SUPPLY VALVE: CLOSE |
| | OFF | INK PUMP: ON<br>INK SUPPLY VALVE: CLOSE | INK PUMP: OFF<br>INK SUPPLY VALVE: OPEN |

INKJET PRINTING APPARATUS

BACKGROUND

1. Technical Field

The present invention relates to an ink-circulation type inkjet printing apparatus.

2. Related Art

An ink-circulation type inkjet printing apparatus for printing in which ink is discharged from an inkjet head while ink is circulated is known.

The ink-circulation type inkjet printing apparatus includes the one in which a pressurizing tank is arranged at a high position and a negative-pressure tank is arranged at a lower position with respect to the inkjet head (see Patent Literature 1, for example).

In this type of inkjet printing apparatus, supply of ink from the pressurizing tank to the ink jet head and recovery of the ink from the inkjet head to the negative-pressure tank are performed by a water head pressure based on a positional relation between the pressurizing tank, the negative-pressure tank, and the inkjet head. To the pressurizing tank, the ink is fed from the negative-pressure tank by an ink pump.

In the type of inkjet printing apparatus as described above, in a standby state in which the ink circulation or printing is not performed, the negative-pressure tank is open to the atmospheric air. On the other hand, the pressurizing tank is brought into a sealed state by a valve in order to prevent the ink from flowing from the pressurizing tank to the negative-pressure tank.

In the inkjet head in which nozzles are arranged with high density in order to make printing with high resolution possible, an ink channel in the inkjet head is narrow, and channel resistance is large. When this type of the inkjet head is to be used, a required ink flowrate cannot be ensured only by the water head pressure by arrangement of the inkjet head, the pressurizing tank, and the negative-pressure tank as described above in some cases.

Thus, in order to ensure the required ink flowrate, an inkjet printing apparatus is known in which a positive pressure is applied to the pressurizing tank and a negative pressure is applied to the negative-pressure tank by using an air pump. In this type of the inkjet printing apparatus, the pressurizing tank and the negative-pressure tank are brought into the sealed state by valves, respectively, in the ink circulation, and a pressure is applied by an air pump. In the standby state, the pressurizing tank is brought into the sealed state, while the negative-pressure tank is brought into a state open to the atmospheric air as described above.

In this type of the inkjet printing apparatus, a normally-closed type electromagnetic valve is used which is open when being electrified and is closed when being non-electrified as a valve for switching the pressurizing tank between the state open to the atmospheric air and the sealed state. On the other hand, a normally-open type electromagnetic valve is used which is closed when being electrified and is open when being non-electrified as a valve for switching the negative-pressure tank between the state open to the atmospheric air and the sealed state. As a result, in a non-electrified state of each valve in the standby state or in a power-off state, the pressurizing tank can be brought into the sealed state, while the negative-pressure tank can be brought into the state open to the atmospheric air.

Here, the pressurizing tank is in the sealed state both during the ink circulation and standby, but when the ink circulation is finished and the state proceeds to the standby state, the valve of the pressurizing tank is temporarily opened so as to open the pressurizing tank to the atmospheric air and to release the pressure. That is because, if the negative-pressure tank is opened to the atmospheric air while the pressurizing tank is sealed and kept in a positive pressure, a pressure applied to the nozzle in the inkjet head rises and breaks meniscus of the ink, and there is a concern of ink leakage.

PRIOR ART DOCUMENT

Patent Literature

[Patent Literature 1] Japanese Patent Application Laid-Open Publication No. 2008-162262

SUMMARY

Problems to be Solved by the Invention

However, if power is shut off during the ink circulation for some reason, the sealed state of the pressurizing tank is maintained while control of temporarily opening the valve of the pressurizing tank cannot be executed. On the other hand, since the normally-open type valve of the negative-pressure tank is opened by shut-off of the power supply, the negative-pressure tank is changed from the sealed state to the atmospheric open state. As a result, since the negative-pressure tank is opened to the atmospheric air while the positive pressure of the pressurizing tank is kept, the pressure of the nozzle in the inkjet head rises, and there is a concern that meniscus of the ink is broken. If the meniscus is broken, there is a concern that ink leaks from the nozzle.

The present invention has been made in view of the above and has an object to provide an inkjet printing apparatus capable of suppression of breakage of meniscus of the ink in the nozzle.

Means for Solving the Problem

In order to achieve the above-described object, an aspect of an inkjet printing apparatus according to the present invention includes: an inkjet head having a nozzle discharging ink; a first tank arranged at a position higher than the inkjet head and storing the ink; a second tank arranged at a position lower than the inkjet head and storing the ink; a circulation path for circulating the ink among the first tank, the inkjet head, and the second tank; a positive-pressure applying portion for applying a positive pressure to one tank of the first and second tanks; a negative-pressure applying portion for applying a negative pressure to the other tank of the first and second tanks; a control unit for executing control of applying a predetermined positive pressure to one of the tanks by the positive-pressure applying portion, and executing control of applying a predetermined negative pressure to the other tank by the negative-pressure applying portion; a common air chamber connected to an air layer on ink in the first tank and an air layer on ink in the second tank through an air channel; a first valve which is closed when being electrified and is open when being non-electrified and opens/closes the air channel between the first tank and the common air chamber; a second valve which is open when being electrified and is closed when being non-electrified and opens/closes the air channel between the second tank and the common air chamber; and a third valve which is closed when being electrified and opened when being non-electrified and switches the second tank between a state shut off from the atmospheric air and a state open to the atmospheric air, in which a nozzle pressure of the inkjet head becomes a meniscus breaking pressure or less when being non-electrified.

DETAILED DESCRIPTION

Figure 1:
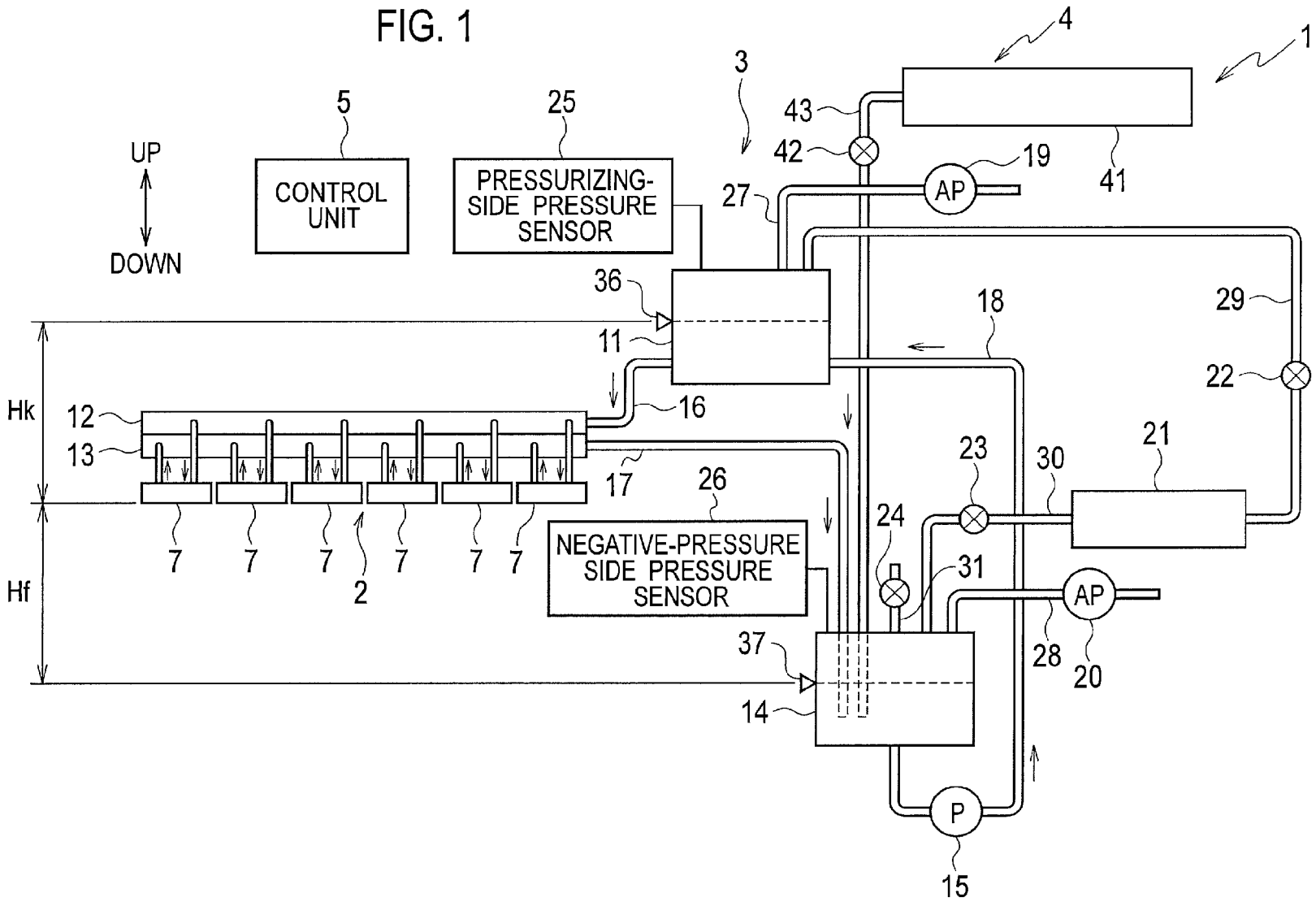
FIG. 1 is an outline configuration view of an inkjet printing apparatus according to a first embodiment.

Embodiments of the present invention will be described below with reference to the drawings. The same or equivalent reference numerals are given to the same or equivalent portions and constituent elements throughout the drawings. However, it should be noted that the drawings are schematic and different from real ones. Moreover, it is needless to say that portions with different relation between dimensions and ratios are included even among the drawings.

The embodiment illustrated below exemplifies an apparatus and the like for embodying a technical idea of the present invention, and the technical idea of the present invention does not limit a material, a shape, a structure, arrangement and the like of each component to those described below. The technical idea of the present invention can be changed in various ways in a claim.

First Embodiment

FIG. 1 is an outline configuration view of an inkjet printing apparatus according to a first embodiment of the present invention. An up-and-down direction in the description below refers to a vertical direction, and up and down in FIG. 1 is assumed to be an up-and-down direction.

As illustrated in FIG. 1, the inkjet printing apparatus 1 according to the first embodiment includes an inkjet head 2, an ink circulation unit 3, an ink supply unit 4, and a control unit 5.

The inkjet head 2 discharges ink supplied by the ink circulation unit 3. The inkjet head 2 is constituted by a plurality of head modules 7.

The head module 7 has an ink chamber storing ink and a plurality of nozzles discharging the ink (none of them is shown). In the ink chamber, a piezo element (not shown) is arranged. The ink is discharged from the nozzle by driving of the piezo element.

The ink circulation unit 3 supplies the ink to the inkjet head 2 while circulating the ink. The ink circulation unit 3 includes a pressurizing tank 11, an ink distributor 12, an ink collector 13, a negative-pressure tank 14, an ink pump 15, ink conduits 16 to 18, a pressurizing-side air pump 19, a negative-pressure side air pump 20, a common air chamber 21, a pressurizing-side communication valve 22, a negative-pressure side communication valve 23, a negative-pressure tank atmospheric air opening valve 24, a pressurizing-side pressure sensor 25, a negative-pressure side pressure sensor 26, and air conduits 27 to 31.

The pressurizing tank 11 stores the ink to be supplied to the inkjet head 2. The ink in the pressurizing tank 11 is supplied to the inkjet head 2 through the ink conduit 16 and the ink distributor 12. An air layer is formed on an ink level in the pressurizing tank 11. The air layer in the pressurizing tank 11 is connected to the common air chamber 21 through the air conduit 29. The pressurizing tank 11 is arranged at a position higher than (above) the inkjet head 2. In the inkjet printing apparatus 1, the pressurizing tank 11 corresponds to a first tank in the claim.

A pressurizing-tank level sensor 36 is provided in the pressurizing tank 11. The pressurizing-tank level sensor 36 is to detect whether or not the ink level in the pressurizing tank 11 has reached a reference height. The pressurizing-tank level sensor 36 outputs a signal indicating "ON" when the ink level in the pressurizing tank 11 is at the reference height or more than the reference height. The pressurizing-tank level sensor 36 outputs a signal indicating "OFF" when the ink level in the pressurizing tank 11 is less than the reference height.

The ink distributor 12 distributes the ink supplied from the pressurizing tank 11 through the ink conduit 16 to each of the head modules 7 of the inkjet head 2.

The ink collector 13 collects the ink not consumed in the inkjet head 2 from each of the head modules 7. The ink collected by the ink collector 13 flows into the negative-pressure tank 14 through an ink conduit 17.

The negative-pressure tank 14 receives the ink not consumed in the inkjet head 2 from the ink collector 13 and stores it. Moreover, the negative-pressure tank 14 stores the ink supplied from an ink cartridge 41 in the ink supply unit 4 which will be described later. An air layer is formed on the ink level in the negative-pressure tank 14. The air layer in the negative-pressure tank 14 is connected to the common air chamber 21 through the air conduit 30. The negative-pressure tank 14 is arranged at a position lower than (below) the inkjet head 2. In the inkjet printing apparatus 1, the negative-pressure tank 14 corresponds to a second tank in the claim.

A negative-pressure tank level sensor 37 is provided in the negative-pressure tank 14. The negative-pressure tank level sensor 37 is to detect whether or not the ink level in the negative-pressure tank 14 has reached a reference height. The negative-pressure tank level sensor 37 outputs a signal indicating "ON" when the ink level in the negative-pressure tank 14 is at the reference height or more and outputs a signal indicating "OFF" when the ink level in the negative-pressure tank 14 is less than the reference height.

The ink pump 15 feeds the ink from the negative-pressure tank 14 to the pressurizing tank 11. The ink pump 15 is provided in the middle of the ink conduit 18.

The ink conduit 16 connects the pressurizing tank 11 and the ink distributor 12 to each other. In the ink conduit 16, the ink flows from the pressurizing tank 11 toward the ink distributor 12. The ink conduit 17 connects the ink collector 13 and the negative-pressure tank 14 to each other. In the ink conduit 17, the ink flows from the ink collector 13 to the negative-pressure tank 14. The ink conduit 18 connects the negative-pressure tank 14 and the pressurizing tank 11 to each other. In the ink conduit 18, the ink flows from the negative-pressure tank 14 toward the pressurizing tank 11. The ink conduits 16 to 18, the ink distributor 12, and the ink collector 13 constitute a circulation path through which the ink is circulated among the pressurizing tank 11, the inkjet head 2, and the negative-pressure tank 14.

The pressurizing-side air pump 19 applies a positive pressure to the pressurizing tank 11 by feeding air to the pressurizing tank 11 through the air conduit 27. The pressurizing-side air pump 19 is arranged in the middle of the air conduit 27. The pressurizing-side air pump 19 corresponds to a positive-pressure applying portion in the claim.

The negative-pressure side air pump 20 applies a negative pressure to the negative-pressure tank 14 by suctioning air from the negative-pressure tank 14 through the air conduit 28. The negative-pressure side air pump 20 is arranged in the middle of the air conduit 28. The negative-pressure side air pump 20 corresponds to a negative-pressure applying portion in the claim.

The common air chamber 21 is a space for releasing the pressure in the pressurizing tank 11 when the ink circulation ends. The common air chamber 21 is connected to the air layer in the pressurizing tank 11 through the air conduit 29 and is connected to the air layer in the negative-pressure tank 14 through the air conduit 30.

The pressurizing-side communication valve 22 opens/closes an air channel in the air conduit 29. When the pressurizing-side communication valve 22 is opened, the air layer in the pressurizing tank 11 is made to communicate with the common air chamber 21. The pressurizing-side communication valve 22 is arranged in the middle of the air conduit 29. The pressurizing-side communication valve 22 is constituted by a normally-open type electromagnetic valve which is closed when being electrified and is open when being non-electrified. In the inkjet printing apparatus 1, the pressurizing-side communication valve 22 corresponds to a first valve in the claim.

The negative-pressure side communication valve 23 opens/closes an air channel in the air conduit 30. When the negative-pressure side communication valve 23 is opened, the air layer in the negative-pressure tank 14 is made to communicate with the common air chamber 21. The negative-pressure side communication valve 23 is arranged in the middle of the air conduit 30. The negative-pressure side communication valve 23 is constituted by a normally-closed type electromagnetic valve which is open when being electrified and is closed when being non-electrified. In the inkjet printing apparatus 1, the negative-pressure side communication valve 23 corresponds to a second valve in the claim.

The negative-pressure tank atmospheric air opening valve 24 switches the negative-pressure tank 14 between a state shut off from the atmospheric air and a state open to the atmospheric air. The negative-pressure tank atmospheric air opening valve 24 is arranged in the middle of the air conduit 31. The negative-pressure tank atmospheric air opening valve 24 is a normally-open type electromagnetic valve. In the inkjet printing apparatus 1, the negative-pressure tank atmospheric air opening valve 24 corresponds to a third valve in the claim.

The pressurizing-side pressure sensor 25 detects a pressure in the pressurizing tank 11. The negative-pressure side pressure sensor 26 detects a pressure in the negative-pressure tank 14.

The air conduit 27 forms a channel of air fed by the pressurizing-side air pump 19 to the pressurizing tank 11. The air conduit 27 has one end connected to the air layer of the pressurizing tank 11 and the other end open to the atmospheric air.

The air conduit 28 forms a channel of air suctioned by the negative-pressure side air pump 20 from the negative-pressure tank 14. The air conduit 28 has one end connected to the air layer of the negative-pressure tank 14 and the other end open to the atmospheric air.

The air conduit 29 forms an air channel between the pressurizing tank 11 and the common air chamber 21. The air conduit 29 has one end connected to the air layer of the pressurizing tank 11 and the other end connected to the common air chamber 21.

The air conduit 30 forms an air channel between the negative-pressure tank 14 and the common air chamber 21. The air conduit 30 has one end connected to the air layer of the negative-pressure tank 14 and the other end connected to the common air chamber 21.

The air conduit 31 forms a channel of air for opening the negative-pressure tank 14 to the atmospheric air. The air conduit 31 has one end connected to the air layer of the negative-pressure tank 14 and the other end open to the atmospheric air.

The ink supply unit 4 supplies the ink to the ink circulation unit 3. The ink supply unit 4 includes the ink cartridge 41, an ink supply valve 42, and an ink conduit 43.

The ink cartridge 41 accommodates ink used for printing by the inkjet head 2. The ink in the ink cartridge 41 is supplied to the negative-pressure tank 14 of the ink circulation unit 3 through the ink conduit 43.

The ink supply valve 42 opens/closes an ink channel in the ink conduit 43. The ink supply valve 42 is constituted by a normally-closed type electromagnetic valve.

The ink conduit 43 connects the ink cartridge 41 and the negative-pressure tank 14 to each other. In ink supply, the ink flows from the ink cartridge 41 toward the negative-pressure tank 14 in the ink conduit 43.

The control unit 5 controls an operation of each portion of the inkjet printing apparatus 1. The control unit 5 includes a CPU, a RAM, a ROM, a hard disk and the like.

The control unit 5 closes the pressurizing-side communication valve 22, opens the negative-pressure side communication valve 23, and closes the negative-pressure tank atmospheric air opening valve 24 when printing is to be performed. Then, the control unit 5 applies the positive pressure to the pressurizing tank 11 by the pressurizing-side air pump 19 and applies the negative pressure to the negative-pressure tank 14 by the negative-pressure side air pump 20. As a result, the ink circulation is performed in the ink circulation unit 3. After the ink circulation is started, the control unit 5 executes control such that the ink is discharged from the inkjet head 2. Here, since the negative-pressure side communication valve 23 is in an open state, the negative pressure is applied not only to the negative-pressure tank 14 but also to the common air chamber 21.

When the ink circulation is to be ended, the control unit 5 reverses the open/closed state of the pressurizing-side communication valve 22, the negative-pressure side communication valve 23, and the negative-pressure tank atmospheric air opening valve 24 from the state during the ink circulation. That is, the control unit 5 opens the pressurizing-side communication valve 22, closes the negative-pressure side communication valve 23, and opens the negative-pressure tank atmospheric air opening valve 24. As a result, the common air chamber 21 is shut off from the negative-pressure tank 14 so as to communicate with the pressurizing tank 11. Since the pressurizing tank 11 is made to communicate with the common air chamber 21 in the negative pressure state, the pressure in the pressurizing tank 11 is lowered. Moreover, since the negative-pressure tank atmospheric air opening valve 24 is opened, the negative-pressure tank 14 is brought into the atmospheric air open state. As a result, the inkjet printing apparatus 1 is brought into the standby state.

Subsequently, an operation of the inkjet printing apparatus 1 will be described.

Figures 2, 3:
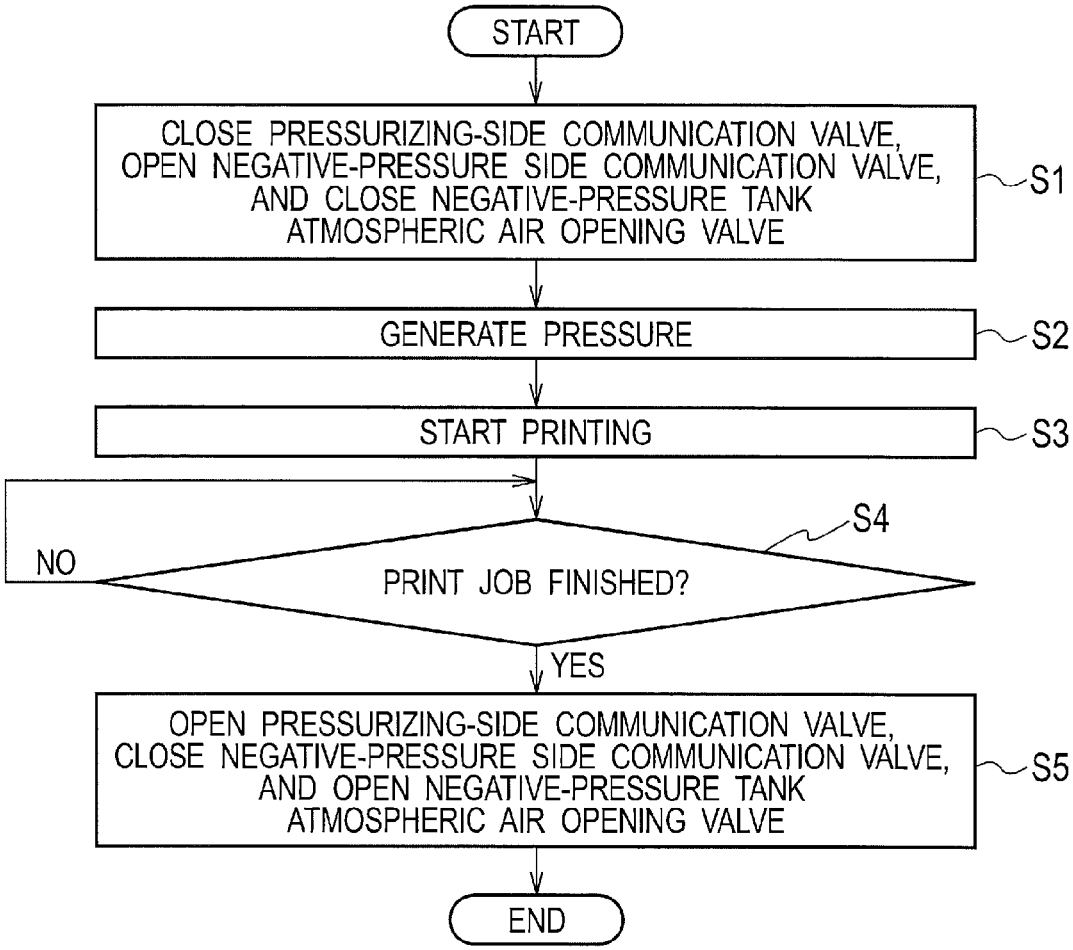
FIG. 2 is a flowchart for explaining an operation of the inkjet printing apparatus according to the first embodiment.
FIG. 3 is an explanatory view of control of an ink pump and an ink supply valve.

FIG. 2 is a flowchart for explaining the operation of the inkjet printing apparatus 1. Processing in the flowchart in FIG. 2 is started when a print job is inputted into the inkjet printing apparatus 1.

At Step S1 in FIG. 2, the control unit 5 closes the pressurizing-side communication valve 22, opens the negative-pressure side communication valve 23, and closes the negative-pressure tank atmospheric air opening valve 24. As a result, the pressurizing tank 11 is shut off from the common air chamber 21, and the negative-pressure tank 14 is made to communicate with the common air chamber 21. The pressurizing tank 11 is singularly brought into a sealed state (state shut off from the atmospheric air). The negative-pressure tank 14 enters the sealed state together with the common air chamber 21.

Subsequently, at Step S2, the control unit 5 generates a pressure. Specifically, the control unit 5 drives the pressurizing-side air pump 19 and feeds air to the air layer in the pressurizing tank 11. As a result, the air layer in the pressurizing tank 11 is pressurized. When the positive pressure in the pressurizing tank 11 detected by the pressurizing-side pressure sensor 25 becomes a predetermined reference value, the control unit 5 stops the pressurizing-side air pump 19. As a result, the pressurizing tank 11 enters a state in which the positive pressure at the reference value is applied.

Moreover, the control unit 5 drives the negative-pressure side air pump 20 and suctions the air from the air layer of the negative-pressure tank 14. As a result, the pressures of the air layer in the negative-pressure tank 14 and the common air chamber 21 are reduced. When the negative pressure in the negative-pressure tank 14 detected by the negative-pressure side pressure sensor 26 becomes a predetermined reference value, the control unit 5 stops the negative-pressure side air pump 20. As a result, the negative-pressure tank 14 and the common air chamber 21 enter a state in which the negative pressure at the reference value is applied.

When the positive pressure is applied to the pressurizing tank 11 and the negative pressure to the negative-pressure tank 14, a flow of the ink is generated from the pressurizing tank 11 toward the negative-pressure tank 14 through the inkjet head 2, and the ink circulation starts.

After that, at Step S3, the control unit 5 controls the inkjet head 2 on the basis of the print job and starts printing.

Here, when the printing is performed while the ink is circulated, the control unit 5 controls the ink pump 15 and the ink supply valve 42 in accordance with the states of the pressurizing-tank level sensor 36 and the negative-pressure tank level sensor 37.

Specifically, as illustrated in FIG. 3, in a state in which both the pressurizing-tank level sensor 36 and the negative-pressure tank level sensor 37 are ON, the control unit 5 turns off the ink pump 15 and closes the ink supply valve 42. In a state in which the pressurizing-tank level sensor 36 is ON and the negative-pressure tank level sensor 37 is OFF, too, the control unit 5 turns off the ink pump 15 and closes the ink supply valve 42.

In a state in which the pressurizing tank level sensor 36 is OFF and the negative-pressure tank level sensor 37 is ON, the control unit 5 turns on the ink pump 15 and closes the ink supply valve 42.

In a state in which both the pressurizing-tank level sensor 36 and the negative-pressure tank level sensor 37 are OFF, the control unit 5 turns off the ink pump 15 and opens the ink supply valve 42.

For example, if the ink circulation is started in the state in which both the pressurizing-tank level sensor 36 and the negative-pressure tank level sensor 37 are ON, the ink flows out of the pressurizing tank 11 to the inkjet head 2, and the pressurizing-tank level sensor 36 is turned off soon. As a result, the control unit 5 drives the ink pump 15 and feeds the ink from the negative-pressure tank 14 to the pressurizing tank 11. The level of the pressurizing tank 11 is raised by inflow of the ink from the negative-pressure tank 14, and when the pressurizing-tank level sensor 36 is turned on, the control unit 5 stops the ink pump 15.

As the printing proceeds, and the ink circulating in the inkjet head 2 and the ink circulation unit 3 decreases, the pressurizing-tank level sensor 36 and the negative-pressure tank level sensor 37 are both turned off soon. In this state, the control unit 5 opens the ink supply valve 42 and performs ink supply to the negative-pressure tank 14.

When the negative-pressure tank level sensor 37 is turned on by the ink supply, the control unit 5 closes the ink supply valve 42 and ends the ink supply to the negative-pressure tank 14. At this time, since the pressurizing-tank level sensor 36 is OFF and the negative-pressure tank level sensor 37 is ON, the control unit 5 drives the ink pump 15 and feeds the ink from the negative-pressure tank 14 to the pressurizing tank 11. When the pressurizing-tank level sensor 36 is turned on, the control unit 5 stops the ink pump 15.

By means of the control of the ink pump 15 and the ink supply valve 42 in accordance with the states of the pressurizing-tank level sensor 36 and the negative-pressure tank level sensor 37 as described above, printing is performed while the levels of the pressurizing tank 11 and the negative-pressure tank 14 are maintained in the vicinity of the reference heights.

Returning to FIG. 2, subsequently to Step S3, at Step S4, the control unit 5 determines whether or not the print job has ended. If it is determined that the print job has not been ended (Step S4: NO), the control unit 5 repeats Step S4.

If it is determined that the print job has been ended (Step S4: YES), at Step S5, the control unit 5 opens the pressurizing-side communication valve 22, closes the negative-pressure side communication valve 23, and opens the negative-pressure tank atmospheric air opening valve 24. As a result, the ink circulation ends, and the inkjet printing apparatus 1 enters the standby state.

As described above, when the ink circulation is finished, the negative-pressure side communication valve 23 is closed, and the negative-pressure tank atmospheric air opening valve 24 is opened, whereby the negative-pressure tank 14 is shut off from the common air chamber 21 and is open to the atmospheric air. Moreover, since the pressurizing-side communication valve 22 is opened, and the negative-pressure side communication valve 23 is closed, the pressurizing tank 11 is made to communicate with the common air chamber 21 and is brought into the sealed state together with the common air chamber 21. Here, since the pressurizing tank 11 to which the positive pressure is applied and the common air chamber 21 to which the negative pressure is applied during the ink circulation are made to communicate with each other, the pressure of the pressurizing tank 11 is lowered. As will be described later, it is configured that the magnitude of the nozzle pressure of the inkjet head 2 becomes a meniscus breakage pressure or less at this time. Therefore, the ink circulation state can proceed to the standby state while breakage of the meniscus of the ink in the nozzle is suppressed.

Here, if the power supply of the inkjet printing apparatus 1 is shut off during the ink circulation, the pressurizing-side communication valve 22, the negative-pressure side communication valve 23, and the negative-pressure tank atmospheric air opening valve 24 are brought into the non-electrified state. Thus, the pressurizing-side communication valve 22 and the negative-pressure tank atmospheric air opening valve 24 of the normally-open type are opened, respectively, and the negative-pressure side communication valve 23 of the normally-closed type is closed. That is, even if the power supply is shut off during the ink circulation and opening/closing control of the pressurizing-side communication valve 22, the negative-pressure side communication valve 23, and the negative-pressure tank atmospheric air opening valve 24 is impossible, these valves are brought into the open/closed state similar to the case in which the ink circulation is finished by the above-described control of the control unit 5.

Therefore, even if the power supply is shut off during the ink circulation, the inkjet printing apparatus 1 can proceed to the standby state while breakage of the meniscus of the ink in the nozzle of the inkjet head 2 is suppressed. If meniscus breakage occurs, ink leaks from the nozzle, but this can be avoided.

Subsequently, a condition that the meniscus of the ink in the nozzle is not broken when the pressurizing-side communication valve 22 and the negative-pressure tank atmospheric air opening valve 24 are opened, respectively, and the negative-pressure side communication valve 23 is closed from the ink circulation state will be described. The pressure is assumed to be a gauge pressure.

A nozzle pressure $P_n$ is expressed by Formula 1 below.

$$P_n = \frac{1}{2}\{(P_k + P_{Hk}) + (P_f + P_{Hf})\} \quad \text{[Formula 1]}$$

Here, $P_k$ is a pressure of the pressurizing tank 11. $P_f$ is a pressure of the negative-pressure tank 14. $P_{HK}$ is a water head pressure based on a height difference (water head difference) $H_k$ between a level of the pressurizing tank 11 and the nozzle surface of the inkjet head 2. $P_{Hf}$ is a water head pressure based on a height difference (water head difference) $H_f$ between a level of the nozzle surface of the inkjet head 2 and the liquid level of the negative-pressure tank 14.

If the nozzle pressure $P_n$ is at a meniscus breakage pressure $P_{n_max}$ or less, the meniscus of the ink in the nozzle is not broken. That is, if Formula 2 below is satisfied, the meniscus of the ink in the nozzle is not broken.

$$P_{n_max} \geq \frac{1}{2}|(P_k + P_{Hk}) + (P_f + P_{Hf})| \quad \text{[Formula 2]}$$

The meniscus breakage pressure $P_{n_max}$ is a value determined in accordance with the nozzle diameter and a surface tension of the ink.

As described above, in the inkjet printing apparatus 1, the pressurizing-side communication valve 22 is opened and the negative-pressure side communication valve 23 is closed, and the common air chamber 21 is shut off from the negative-pressure tank 14 and the common air chamber 21 is made to communicate with the pressurizing tank 11 during the ink circulation. Assuming that pressure of the pressurizing tank 11 and the common air chamber 21 after the communication between the pressurizing tank 11 and the common air chamber 21 is $P_x$, Formula 3 below is established by Boyle's Law.

$$P_k \times V_k + P_f \times V_{com} = P_x \times (V_k + V_{com}) \quad \text{[Formula 3]}$$

Here, $V_k$ is an air amount of a pressurizing system. $V_{com}$ is an air amount of a common air chamber system.

The air amount $V_k$ of the pressurizing system is an air amount of a portion made to communicate with the pressurizing tank 11 during the ink circulation and to which the positive pressure is applied together with the pressurizing tank 11. The air amount $V_k$ of the pressurizing system is expressed by Formula 4 below.

$$V_k = V_{kt} + V_{kr1} + V_{kr2} \quad \text{[Formula 4]}$$

Here, $V_{kt}$ is a capacity of the air layer in the pressurizing tank 11. That is, $V_{kt}$ corresponds to a volume of a space above the reference height of the level in the pressurizing tank 11. $V_{kr1}$ is a capacity of a portion of the air conduit 27 between the pressurizing tank 11 and the pressurizing-side air pump 19. $V_{kr2}$ is a capacity of a portion of the air conduit 29 between the pressurizing tank 11 and the pressurizing-side communication valve 22.

The air amount $V_{com}$ of the common air chamber system is an air amount of a portion made to communicate with the pressurizing tank 11 after the ink circulation is finished in a portion made to communicate with the negative-pressure tank 14 during the ink circulation and to which the negative pressure is applied together with the negative-pressure tank 14. The air amount $V_{com}$ of the common air chamber system is expressed by Formula 5 below.

$$V_{com} = V_{ct} + V_{cr1} + V_{cr2} \quad \text{[Formula 5]}$$

Here, $V_{ct}$ is a capacity of the common air chamber 21. $V_{cr1}$ is a capacity of a portion in the air conduit 30 between the common air chamber 21 and the negative-pressure side communication valve 23. $V_{cr2}$ is a capacity of a portion in the air conduit 29 between the common air chamber 21 and the pressurizing-side communication valve 22.

From the Formula 3, the pressure $P_x$ of the pressurizing tank 11 after being made to communicate with the common air chamber 21 is expressed by the Formula 6 below.

$$P_x = \frac{P_k \times V_k + P_f \times V_{com}}{V_k + V_{com}} \quad \text{[Formula 6]}$$

When the pressurizing tank 11 and the common air chamber 21 are made to communicate with each other at the end of the ink circulation, the negative-pressure tank atmospheric air opening valve 24 is opened, whereby the negative-pressure tank 14 is opened to the atmospheric air. As a result, $P_f = 0$ is obtained.

Therefore, if Formula 7 below obtained by substituting $P_k = P_x$, $P_f = 0$ in the above-described Formula 2 is satisfied, when the ink circulation state proceeds to the standby state, meniscus of the ink in the nozzle is not broken. The right side in Formula 7 is a magnitude of the nozzle pressure according to the pressure $P_x$ after communication between the pressurizing tank 11 and the common air chamber 21.

$$P_{n_max} \geq \left|\frac{P_x + P_{Hk} + P_{Hf}}{2}\right| \quad \text{[Formula 7]}$$

By substituting Formula 6 in Formula 7 and deforming it, Formula 8 below can be obtained. The condition that meniscus of the ink in the nozzle is not broken when the ink circulation state proceeds to the standby state is that Formula 8 is satisfied.

$$2P_{n_max} \geq \left|\frac{P_k \times V_k + P_f \times V_{com}}{V_k + V_{com}} + P_{Hk} + P_{Hf}\right| \quad \text{[Formula 8]}$$

The inkjet printing apparatus 1 is designed such that the air layer of the pressurizing tank 11 and the common air chamber 21 have such capacities that Formula 8 is satisfied. As a result, the magnitude of the nozzle pressure of the inkjet head 2 when the ink circulation state proceeds to the standby state becomes the meniscus breakage pressure or less.

As described above, in the inkjet printing apparatus 1, when the power supply is shut off during the ink circulation, the normally-open type pressurizing-side communication valve 22 and the negative-pressure tank atmospheric air opening valve 24 are opened, respectively, and the normally-closed type negative-pressure side communication valve 23 is closed. As a result, the negative-pressure tank 14 is shut off from the common air chamber 21 and is opened to the atmospheric air. Moreover, the pressurizing tank 11 is made to communicate with the common air chamber 21. Since the pressurizing tank 11 to which the positive pressure is applied during the ink circulation is made to communicate with the common air chamber 21 to which the negative pressure is applied, the pressure of the pressurizing tank 11 is lowered. Since the air layer of the pressurizing tank 11 and the common air chamber 21 have such capacities that the magnitude of the nozzle pressure according to the pressure $P_x$ after communication between the pressurizing tank 11 and the common air chamber 21 becomes the meniscus breakage pressure or less, the nozzle pressure after shut-off of the power supply (when being non-electrified) can be suppressed to the meniscus breakage pressure or less. Thus, breakage of meniscus of the ink in the nozzle can be suppressed. As a result, ink leakage from the nozzle can be suppressed.

Second Embodiment

Figure 4:
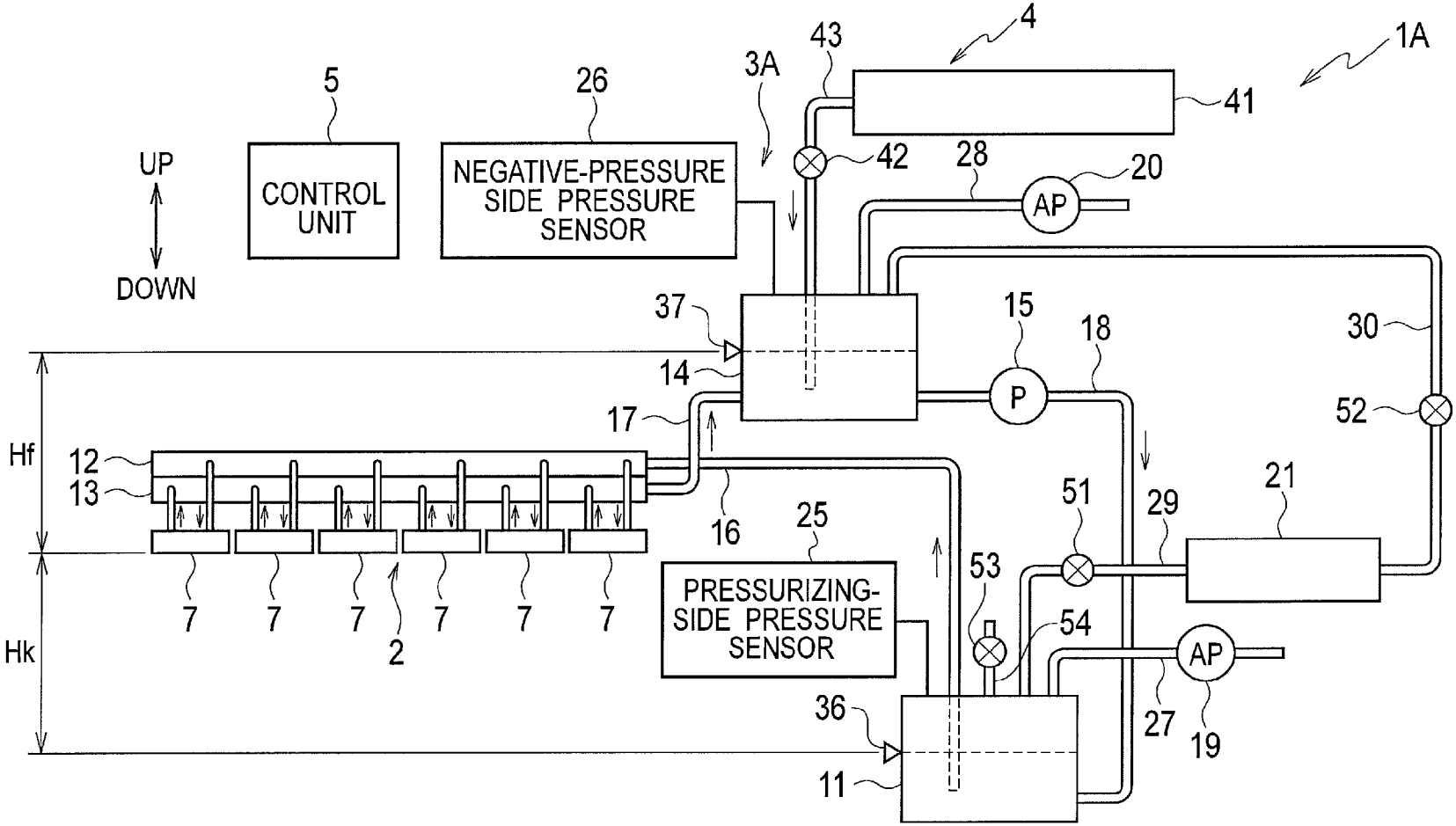
FIG. 4 is an outline configuration view of an inkjet printing apparatus according to a second embodiment.

FIG. 4 is an outline configuration view of an inkjet printing apparatus according to a second embodiment.

As illustrated in FIG. 4, the inkjet printing apparatus 1A according to the second embodiment has a constitution in which the ink circulation unit 3 is replaced by an ink circulation unit 3A with respect to the inkjet printing apparatus 1 in the first embodiment as illustrated in FIG. 1.

The ink circulation unit 3A has arrangement of the pressurizing tank 11 and the negative-pressure tank 14 changed with respect to the ink circulation portion 3 in FIG. 1. Moreover, the ink circulation unit 3A is, with respect to the ink circulation portion 3, a constitution in which the pressurizing-side communication valve 22 and the negative-pressure side communication valve 23 are replaced by the pressurizing-side communication valve 51 and the negative-pressure side communication valve 52, respectively, the negative-pressure tank atmospheric air opening valve 24 and the air conduit 31 are omitted, and a pressurizing tank atmospheric air opening valve 53 and an air conduit 54 are added.

In the ink circulation unit 3A, the pressurizing tank 11 is arranged at a position lower than (below) the inkjet head 2. The negative-pressure tank 14 is arranged at a position higher than (above) the inkjet head 2. In the inkjet printing apparatus 1A, the negative-pressure tank 14 corresponds to the first tank in the claim, and the pressurizing tank 11 corresponds to the second tank in the claim.

The pressurizing-side communication valve 51 is unlike the pressurizing-side communication valve 22 in the ink circulation unit 3 in FIG. 1 but is constituted by a normally-closed type electromagnetic valve. In the inkjet printing apparatus 1A, the pressurizing-side communication valve 51 corresponds to the second valve in the claim.

The negative-pressure side communication valve 52 is unlike the negative-pressure side communication valve 23 in the ink circulation unit 3 in FIG. 1 but is constituted by a normally-open type electromagnetic valve. In the inkjet printing apparatus 1A, the negative-pressure side communication valve 52 corresponds to the first valve in the claim.

The pressurizing-tank atmospheric air opening valve 53 switches the pressurizing tank 11 between a state shut off from the atmospheric air and a state open to the atmospheric air. The pressurizing-tank atmospheric air opening valve 53 is arranged in the middle of the air conduit 54. The pressurizing-tank atmospheric air opening valve 53 is constituted by a normally-open type electromagnetic valve. In the inkjet printing apparatus 1A, the pressurizing-tank atmospheric air opening valve 53 corresponds to the third valve in the claim.

The air conduit 54 forms an air channel for opening the pressurizing tank 11 to the atmospheric air. The air conduit 54 has one end connected to the air layer in the pressurizing tank 11 and the other end open to the atmospheric air.

Subsequently, an operation of the inkjet printing apparatus 1A will be described.

Figure 5:
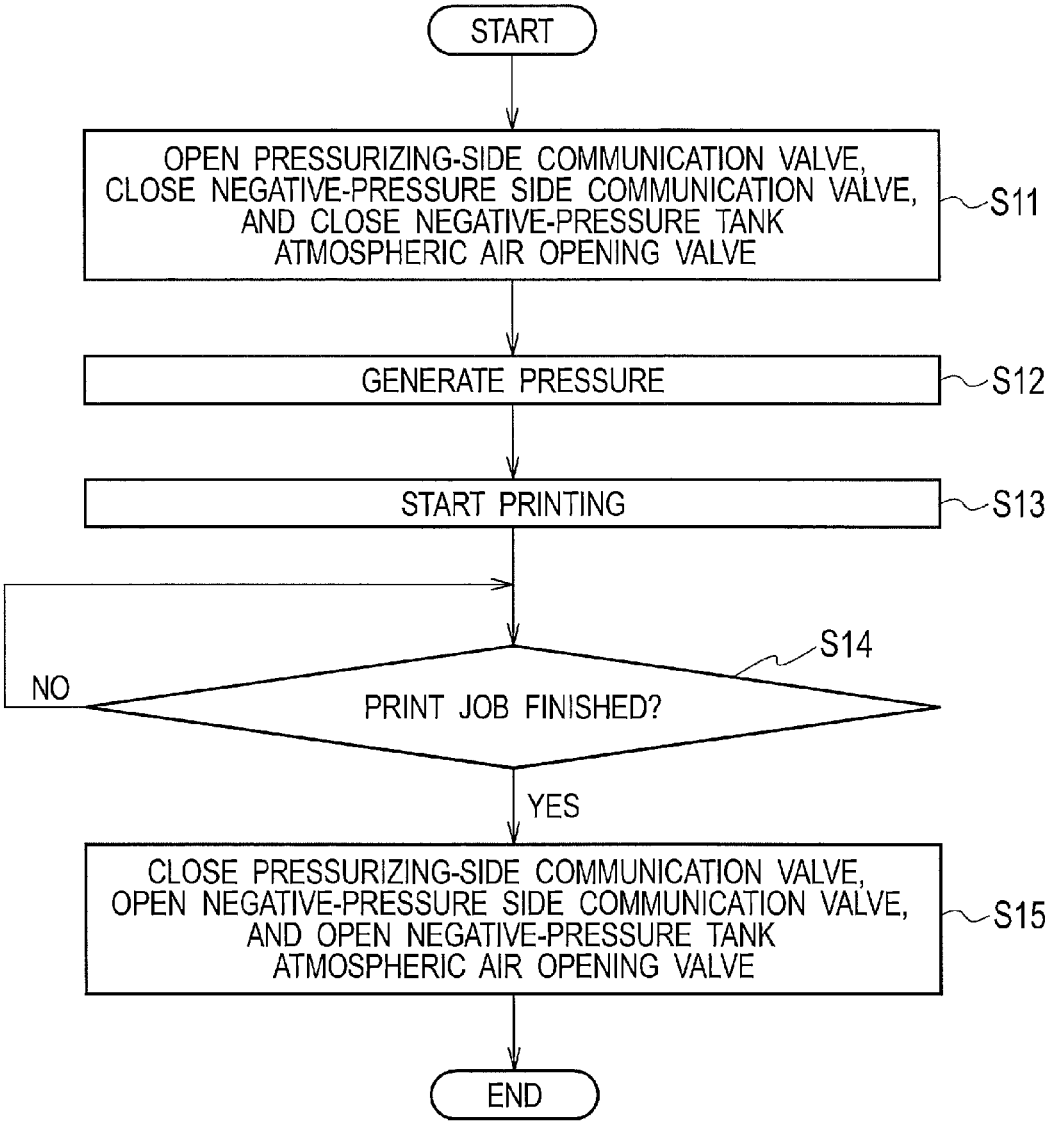
FIG. 5 is a flowchart for explaining an operation during printing of the inkjet printing apparatus according to the second embodiment.

FIG. 5 is a flowchart for explaining the operation of the inkjet printing apparatus 1A. Processing in the flowchart in FIG. 5 is started when a print job is inputted into the inkjet printing apparatus 1A.

At Step S11 in FIG. 5, the control unit 5 opens the pressurizing-side communication valve 51, closes the negative-pressure side communication valve 52, and closes the pressurizing-tank atmospheric air opening valve 53. As a result, the negative-pressure tank 14 is shut off from the common air chamber 21, and the pressurizing tank 11 is made to communicate with the common air chamber 21. The negative-pressure tank 14 is singularly brought into a sealed state. The pressurizing tank 11 enters the sealed state together with the common air chamber 21.

Subsequently, at Step S12, the control unit 5 generates a pressure. Processing at Step S12 is similar to the above-described processing at Step S2 in FIG. 2. By means of this processing, the negative pressure at a reference value is applied to the negative-pressure tank 14, and the positive pressure at a reference value is applied to the pressurizing tank 11 and the common air chamber 21. As a result, a flow of the ink from the pressurizing tank 11 toward the negative-pressure tank 14 through the inkjet head 2 is generated, and the ink circulation is started.

Processing at Steps S13 and S14 subsequent to Step S12 is similar to the above-described processing at Steps S3 and S4 in FIG. 2. Moreover, control of the ink pump 15 and the ink supply valve 42 illustrated in FIG. 3 is also executed similarly.

If it is determined at Step S14 that the print job has been finished (Step S14: YES), at Step S15, the control unit 5 closes the pressurizing-side communication valve 51, opens the negative-pressure side communication valve 52, and opens the pressurizing-tank atmospheric air opening valve 53. As a result, the ink circulation is finished, and the inkjet printing apparatus 1 enters the standby state.

As described above, when the ink circulation is finished, the pressurizing-side communication valve 51 is closed, and the pressurizing tank atmospheric air opening valve 53 is opened, whereby the pressurizing tank 11 is shut off from the common air chamber 21 and is opened to the atmospheric air. Moreover, the negative-pressure side communication valve 52 is opened, and the pressurizing-side communication valve 51 is closed, whereby the negative-pressure tank 14 is made to communicate with the common air chamber 21 and is brought into the sealed state together with the common air chamber 21. Here, since the negative-pressure tank 14 to which the negative pressure is applied and the common air chamber 21 to which the positive pressure is applied during the ink circulation are made to communicate with each other, the pressure of the negative-pressure tank 14 rises. As will be described later, it is configured that the magnitude of the nozzle pressure of the inkjet head 2 becomes the meniscus breakage pressure or less at this time. Therefore, the ink circulation state can proceed to the standby state while breakage of meniscus of the ink in the nozzle is suppressed.

Here, if the power supply of the inkjet printing apparatus 1A is shut off during the ink circulation, the pressurizing-side communication valve 51, the negative-pressure side communication valve 52, and the pressurizing-tank atmospheric air opening valve 53 are brought into the non-electrified state. Thus, the negative-pressure side communication valve 52 and the pressurizing-tank atmospheric air opening valve 53 of the normally-open type are opened, respectively, and the pressurizing-side communication valve 51 of the normally-closed type is closed. That is, even if the power supply is shut off during the ink circulation and opening/closing control of the pressurizing-side communication valve 51, the negative-pressure side communication valve 52, and the pressurizing-tank atmospheric air opening valve 53 is impossible, these valves are brought into the open/closed state similar to the case in which the ink circulation is finished by the above-described control of the control unit 5.

Therefore, even if the power supply is shut off during the ink circulation, the inkjet printing apparatus 1A can proceed to the standby state while breakage of the meniscus of the ink in the nozzle of the inkjet head 2 is suppressed. If meniscus breakage occurs, air suctioning from the nozzle occurs, but this can be avoided.

In the inkjet printing apparatus 1A, a condition that meniscus of the ink in the nozzle is not broken when the ink circulation state proceeds to the standby state is satisfaction of Formula 9 below. The Formula 9 is derived by the same method as the above-described Formula 8.

$$2P_{n_max} \geq \left| \frac{P_f \times V_f + P_k \times V_{com}}{V_f + V_{com}} + P_{Hk} + P_{Hf} \right| \quad \text{[Formula 9]}$$

Here, $V_f$ is an air amount of a negative-pressure system. The air amount $V_f$ of the negative-pressure system is an air amount of a portion made to communicate with the negative-pressure tank 14 during the ink circulation and to which the negative pressure is applied together with the negative-pressure tank 14. The air amount $V_f$ of the negative-pressure system is expressed by Formula 10 below.

$$V_f = V_{ft} + V_{fr1} + V_{fr2} \quad \text{[Formula 10]}$$

Here, $V_{ft}$ is a capacity of the air layer in the negative-pressure tank 14. That is, $V_{ft}$ corresponds to a volume of a space above the reference height of the level in the negative-pressure tank 14. $V_{fr1}$ is a capacity of a portion of the air conduit 28 between the negative-pressure tank 14 and the negative-pressure side air pump 20. $V_{fr2}$ is a capacity of a portion of the air conduit 30 between the negative-pressure tank 14 and the negative-pressure side communication valve 52.

The air amount $V_{com}$ of a common air chamber system in the inkjet printing apparatus 1A is an air amount of a portion made to communicate with the negative-pressure tank 14 after the ink circulation is finished in a portion made to communicate with the pressurizing tank 11 during the ink circulation and to which the positive pressure is applied together with the pressurizing tank 11.

The air amount $V_{com}$ of the common air chamber system is expressed by the above-described Formula 5, and in the inkjet printing apparatus 1A, $V_{cr1}$ in Formula 5 is a capacity of a portion in the air conduit 30 between the common air chamber 21 and the negative-pressure side communication valve 52. $V_{cr2}$ is a capacity of a portion in the air conduit 29 between the common air chamber 21 and the pressurizing-side communication valve 51.

The inkjet printing apparatus 1A is designed such that the air layer of the negative-pressure tank 14 and the common air chamber 21 have such capacities that Formula 9 is satisfied. As a result, the magnitude of the nozzle pressure of the inkjet head 2 when the ink circulation state proceeds to the standby state becomes the meniscus breakage pressure or less.

In the inkjet printing apparatus 1A as above, too, the nozzle pressure after the power supply shut-off can be kept to the meniscus breakage pressure or less. Thus, breakage of meniscus of the ink in the nozzle can be suppressed. As a result, air suctioning from the nozzle can be suppressed.

While embodiments of the present invention have been described hereinabove, these embodiments are merely illustration described for the purpose of facilitating the understanding of the present invention, and the present invention is not limited to the embodiments. The technical scope of the present invention is not limited to the specific technical matters disclosed in the embodiments but includes various modifications, changes, alternative techniques, and the like which can readily be conceived therefrom.

The entire content of Japanese Patent Application No. 2014-155064 (filed on Jul. 30, 2014) is incorporated herein by reference.

INDUSTRIAL APPLICABILITY

According to the features of the inkjet printing apparatus according to the present invention, since the nozzle pressure of the inkjet head becomes the meniscus breakage pressure or less in the non-electrified state, even if the power supply is shut off during the ink circulation, the nozzle pressure after the shut-off of the power supply can be kept to the meniscus breakage pressure or less. Therefore, breakage of meniscus of the ink in the nozzle can be suppressed.

REFERENCE SIGNS LIST

1, 1A inkjet printing apparatus
2 inkjet head
3, 3A ink circulation unit
4 ink supply unit
5 control unit
11 pressurizing tank
12 ink distributor
13 ink collector
14 negative-pressure tank
15 ink pump
16 to 18, 43 ink conduit
19 pressurizing-side air pump
20 negative-pressure side air pump
21 common air chamber
22, 51 pressurizing-side communication valve
23, 52 negative-pressure side communication valve
24 negative-pressure tank atmospheric air opening valve
25 pressurizing-side pressure sensor
26 negative-pressure side pressure sensor
27 to 31 air conduit
41 ink cartridge
42 ink supply valve
53 pressurizing-tank atmospheric air opening valve

What is claimed is:

1. An inkjet printing apparatus comprising:

an inkjet head having a nozzle discharging ink;

a first tank arranged at a position higher than the inkjet head and storing the ink;

a second tank arranged at a position lower than the inkjet head and storing the ink;

a circulation path for circulating the ink among the first tank, the inkjet head, and the second tank;

a positive-pressure applying portion for applying a positive pressure to one tank of the first and second tanks;

a negative-pressure applying portion for applying a negative pressure to the other tank of the first and second tanks;

a control unit for executing control of applying a predetermined positive pressure to one of the tanks by the positive-pressure applying portion, and executing control of applying a predetermined negative pressure to the other tank by the negative-pressure applying portion;

a common air chamber connected to an air layer on ink in the first tank and an air layer on ink in the second tank through an air channel;

a first valve which is closed when being electrified and is open when being non-electrified and opens/closes the air channel between the first tank and the common air chamber;

a second valve which is open when being electrified and is closed when being non-electrified and opens/closes the air channel between the second tank and the common air chamber; and a third valve which is closed when being electrified and opened when being non-electrified and switches the second tank between a state shut off from the atmospheric air and a state open to the atmospheric air, wherein a nozzle pressure of the inkjet head becomes a meniscus breaking pressure or less when being non-electrified, and the air channel connecting the common air chamber to the air layer in the first tank and the air layer in the second tank is different than the circulating path that circulates the ink between the first tank, the inkjet head and the second tank.

2. The inkjet printing apparatus according to claim 1, wherein the air channel is configured to allow air flow between the air layer in the first tank, the common air chamber, and the air layer in the second tank.

3. The inkjet printing apparatus according to claim 1, wherein the positive-pressure applying portion applies a positive pressure to the first tank through a first air conduit, the negative-pressure applying portion applies a negative pressure to the second tank through a second air conduit, the first air conduit is connected to the air layer of the first tank, and the second air conduit is connected to the air layer of the second tank.

4. The inkjet printing apparatus according to claim 1, wherein the circulation path includes a first ink conduit that connects the ink in the first tank to the inkjet head, a second ink conduit that connects the inkjet head to the ink in the second tank, and a third ink conduit that connects the ink in the second tank to the ink in the first tank.

5. The inkjet printing apparatus according to claim 1, wherein the inkjet head includes an ink distributor that receives ink from the first tank and an ink collector that collects ink not consumed in the inkjet head, and the circulation path includes a first ink conduit that is configured to supply the ink in the first tank to the ink distributor, a second ink conduit that is configured to flow ink collected in the ink collector to the second tank, and a third ink conduit that connects the ink in the second tank to the ink in the first tank.

* * * * *